US008869568B2

(12) United States Patent
Hong et al.

(10) Patent No.: US 8,869,568 B2
(45) Date of Patent: Oct. 28, 2014

(54) WASHING MACHINE

(75) Inventors: Sang Wook Hong, Seoul (KR); Ji Hee Kim, Seoul (KR); Sang Su Lee, Seoul (KR); Sun Young Park, Seoul (KR); Bon Kwon Koo, Seoul (KR); Jae Won Chang, Seoul (KR); Ki Young Kang, Seoul (KR); Chang Kwon Park, Seoul (KR)

(73) Assignee: LG Electronics Inc., Seoul (KR)

( * ) Notice: Subject to any disclaimer, the term of this patent is extended or adjusted under 35 U.S.C. 154(b) by 214 days.

(21) Appl. No.: 13/260,186

(22) PCT Filed: Sep. 11, 2009

(86) PCT No.: PCT/KR2009/005180

§ 371 (c)(1),
(2), (4) Date: Sep. 23, 2011

(87) PCT Pub. No.: WO2010/128728

PCT Pub. Date: Nov. 11, 2010

(65) Prior Publication Data

US 2012/0036902 A1 Feb. 16, 2012

(30) Foreign Application Priority Data

May 4, 2009 (KR) ..... 10-2009-0039050

(51) Int. Cl.

| | |
|---|---|
| ***B08B 3/12*** | (2006.01) |
| ***D06F 37/00*** | (2006.01) |
| ***D06F 39/00*** | (2006.01) |
| ***D06F 58/20*** | (2006.01) |
| ***D06F 29/00*** | (2006.01) |

(52) U.S. Cl.

CPC ..... *D06F 29/00* (2013.01); *D06F 39/006* (2013.01); *D06F 58/20* (2013.01)

USPC ..... 68/3 R

(58) Field of Classification Search

None

See application file for complete search history.

(56) References Cited

U.S. PATENT DOCUMENTS

| | | | | |
|---|---|---|---|---|
| 7,168,274 | B2 * | 1/2007 | Slutsky et al. | 68/19 |
| 7,421,865 | B2 * | 9/2008 | Lee et al. | 68/15 |

FOREIGN PATENT DOCUMENTS

| | | | |
|---|---|---|---|
| GB | 2375812 | A | 11/2002 |
| KR | 2006115231 | A | 11/2006 |

OTHER PUBLICATIONS

International Search Report issued in International Application No. PCT/KR2009/005180 mailed Oct. 11, 2010.

* cited by examiner

*Primary Examiner* — Jason Ko

(74) *Attorney, Agent, or Firm* — Fish & Richardson P.C.

(57) ABSTRACT

A washing machine is disclosed, which includes a receiving part (2) to receive laundry, a supply path (4) to supply outside air of the receiving part (2) into the receiving part (2), a heating member (41) to heat the air introduced in the supply path (4), an exhaust path (5) through which the air in the receiving part (2) is exhausted to the outside, and a heat transfer part (6) to transfer heat of the air flowing through the exhaust path (5) to the air flowing in through the supply path (4).

19 Claims, 4 Drawing Sheets

WASHING MACHINE

CROSS REFERENCE TO RELATED APPLICATIONS

This application is a U.S. National Phase Application under 35 U.S.C. §371 of International Application PCT/KR2009/005180, filed on Sep. 11, 2009, which claims the benefit of Korean Application No. 10-2009-0039050, filed on May. 4, 2009, the entire contents of which are hereby incorporated by reference in their entireties.

TECHNICAL FIELD

The present invention relates to a washing machine.

BACKGROUND ART

Generally, a washing machine refers to an apparatus capable of washing and drying laundry, including the concepts of a washer, a dryer, and a combined washer and dryer.

The dryer, as an apparatus to dry washed laundry using hot air, may be classified into an exhausting type dryer and a condensing type (circulating type) dryer.

The condensing type dryer is structured to circulate hot and dry air through a receiving part storing laundry, to thereby dry the laundry. More specifically, the condensing type dryer dries the laundry through processes of supplying the hot and dry air into the receiving part, performing heat exchange between the hot and dry air and the laundry, condensing humid air having undergone the heat exchange, and heating the condensed air and resupplying the heated air to the receiving part.

Meanwhile, the exhausting type dryer also supplies hot air into the receiving part storing laundry but, however, discards the air heat-exchanged with the laundry to the outside. To this end, the exhausting type dryer includes a device to heat the air being supplied to the receiving part, a supply path to supply the heated air to the receiving part therethrough, and an exhaust path to exhaust the heat-exchanged air to the outside of the receiving part.

The exhausting type dryer has generally been applied to a washing machine since it has a relatively simple structure compared to the condensing type dryer. However, the exhausting type dryer is not able to recycle heat remaining in the humid air being exhausted through the exhaust path.

DISCLOSURE OF INVENTION

Technical Problem

An object of the present invention devised to solve the problem lies on a washing machine capable of recycling heat retained in air being discarded during a laundry drying process.

Solution to Problem

The object of the present invention can be achieved by providing a washing machine including a receiving part to receive laundry, a supply path to supply air into the receiving part, a heating member to heat the air being introduced in the supply path, an exhaust path through which the air in the receiving part is exhausted to the outside, and a heat transfer part to transfer heat of the air being exhausted through the exhaust path to the air being introduced in the supply path.

The heat transfer part may include a heat absorbing unit disposed on the exhaust path to exchange heat with the air being exhausted, and a heat generating unit disposed on the supply path to exchange heat with the air being introduced in the supply path.

The heat absorbing unit and the heat generating unit of the heat transfer part may include be heat-conductively connected to each other.

The heat generating part may be disposed on the supply path so that the air introduced in the supply path performs heat exchange before being heated by the heating member.

The exhaust path may further include a fan to exhaust the air in the receiving part.

The exhaust path and the supply path may each have a contacting surface where outer circumferential surfaces of the respective paths contact each other.

The heat transfer part may include a partition formed at the contacting surface to separate the supply path and the exhaust path from each other, a heat absorbing unit connected to the partition and extended into the exhaust path, and a heat generating unit connected to the partition and extended into the supply path.

The receiving part may include a tub connected with the supply path and the exhaust path and adapted to store wash water therein, and a drum rotatably mounted in the tub to receive laundry therein.

In another aspect of the present invention, provided herein is a washing machine including a first receiving part to receive laundry, a second receiving part to receive wash water and laundry, a supply path to supply air to the first receiving part therethrough, a heating member to heat the air in the supply path, an exhaust path to exhaust the air in the first receiving part to the outside of the first receiving part therethrough, and a heat transfer part to transfer heat retained in the air being exhausted through the exhaust path to the wash water supplied to the second receiving part.

The heat transfer part may include a storage part to store wash water to be supplied to the second receiving part, and a heat exchange pipe extended from the exhaust path and disposed in the storage part.

The heat exchange pipe may include a plurality of heat exchanger fins.

The first receiving part may include a tub fluidly communicated with the supply path and the exhaust path and adapted to store wash water, and a drum rotatably mounted in the tub and adapted to receive laundry.

The second receiving part may include a tub to store wash water, and a drum rotatably mounted in the tub and adapted to receive laundry.

The second receiving part may further includes a supply pipe to supply the wash water to the tub, and the heat transfer part is a part of the supply pipe which is disposed in the exhaust path.

The heat transfer part may further include a heat exchanger fin formed on an outer circumferential surface of the supply pipe disposed in the exhaust path.

Advantageous Effects of Invention

The present invention provides a washing machine capable of utilizing heat remaining in air being discarded during drying of laundry, in producing a heated air necessary for the drying of laundry.

The washing machine according to embodiments of the present invention is capable of utilizing the waste heat remaining in the air being discarded, in heating wash water necessary for washing of laundry.

BRIEF DESCRIPTION OF DRAWINGS

The accompanying drawings, which are included to provide a further understanding of the invention, illustrate embodiments of the invention and together with the description serve to explain the principle of the invention.

In the drawings.

BEST MODE FOR CARRYING OUT THE INVENTION

Reference will now be made in detail to the preferred embodiments of the present invention, examples of which are illustrated in the accompanying drawings. So long as being not specially defined, all terms in the context of describing the invention may be commonly understood by those skilled in the art to have the same meaning as the general meaning, or may be dedicatedly defined in the specification when having a specific meaning conflicting with the general meaning thereof.

Figure 1:
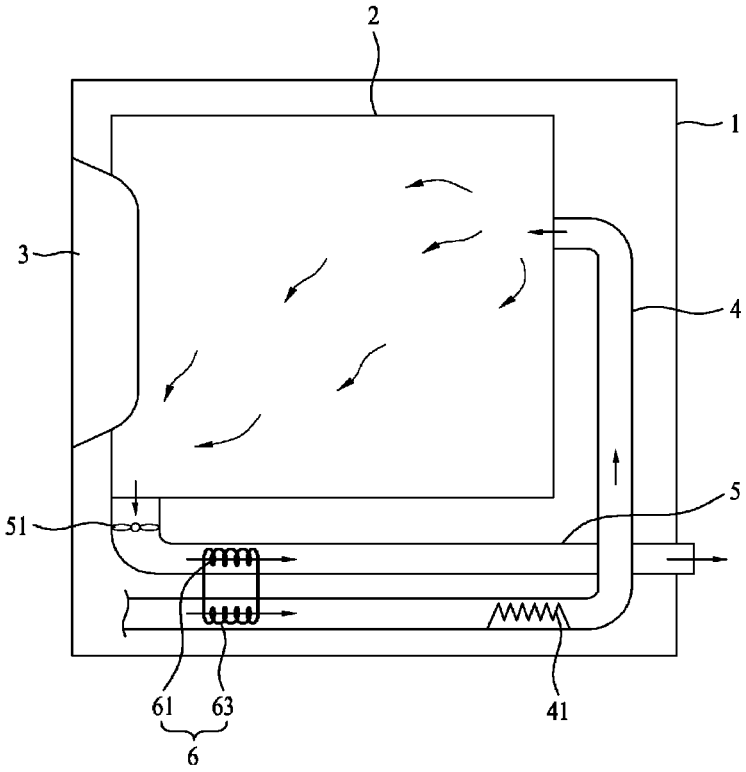
FIG. 1 illustrates a concept view of a washing machine according to a first embodiment of the present invention.

First, a washing machine according to one embodiment of the present invention will be described with reference to FIG. 1. Referring to FIG. 1, the washing machine includes a cabinet 1 constituting the exterior appearance thereof, a receiving part 2 formed in the cabinet 1 to store laundry, a door 3 formed on a front of the cabinet to open and close the receiving part 2, a supply path 4 through which outside air is supplied into the receiving part 2, and an exhaust path 5 through which the air in the receiving part 2 is exhausted to the outside.

The receiving part 2 supplies a space to store laundry so that heat exchange between the laundry and a heated air supplied through the supply path 4 can be performed therein.

The receiving part 2 may be formed in a rotatable structure to improve the efficiency of a drying operation.

That is, in this case, a member for guiding rotation of the receiving part 2 and a motor for rotating the receiving part 2 may be provided at the front and the rear of the receiving part 2 such that the laundry is agitated as the heated air is flowing in. Accordingly, the drying time can be reduced.

A specific configuration of the guide member and the motor will not be described in detail since such configuration may easily be achieved by those skilled in the art.

One side of the supply path 4 is fluidly communicated with the receiving part 2. The other side may be formed at the inside or the outside of the cabinet 1 so as to draw the air out of the receiving part 2.

Since the supply path 4 serves as a path to supply the heated air to the receiving part 2 therethrough, a heating member 41 may be provided in the supply path 4 to heat air.

The heating member 41 may heat the air flowing in through the supply path 4 using a resistance heat of an electric resistance such as a coil or through combustion of fuel such as gas.

One side of the exhaust path 5 is fluidly communicated with the receiving part 2 while the other side is fluidly communicated with the outside of the cabinet 1 so that the air in the receiving part 2 can be exhausted. Exemplarily, a fan 51 is mounted on the exhaust path 5 to forcibly blow the air in the receiving part 2 outward.

When the above-structured washing machine performs drying of laundry, the fan 51 is driven to forcibly exhaust the air in the receiving part 2. As the inside air of the receiving part 2 is exhausted by the fan 51, a pressure in the receiving part 2 will be decreased, thereby drawing the outside air into the receiving part 2 through the supply path 4.

Here, the heated air is introduced into the receiving part 2 due to the heating member 41 mounted on the supply path 4. The air heat-exchanged with the laundry in the receiving part 2 is exhausted out of the cabinet 1 by the fan 51 and the exhaust path 5.

However, since complete heat exchange between the heated air supplied to the receiving part 2 and the laundry is actually infeasible, heat supplied from the heating member 41 remains in the air being discarded through the exhaust path 5.

Accordingly, the embodiment of the present invention adopts a heat transfer part 6 to utilize the heat of the air being discarded through the exhaust path 5.

The heat transfer part 6 is structured to perform heat exchange with the air being discarded through the exhaust path 5 and then supply heat to the air flowing in through the supply path 4.

For this purpose, the heat transfer part 6 includes a heat absorbing unit 61 formed on the exhaust path 5, and a heat generating unit 63 formed on the supply path 4. Exemplarily, the heat absorbing unit 61 and the heat generating unit 63 are interconnected by a heat conductive material.

That is, the heat absorbing unit 61 and the heat generating unit 63 may be made of a material capable of performing heat exchange with the air flowing through the corresponding paths 4 and 5, and be interconnected by a heat conductive material.

For example, the heat absorbing unit 61 and the heat generating unit 63 provided in the form of a coil may be disposed in the exhaust path 5 and the supply path 4, respectively, and then connected by a heat conductive material as illustrated in the drawing.

However, the heat absorbing unit 61 and the heat generating unit 63 may be configured in various other manners without being limited to this embodiment. For example, the heat absorbing unit 61 and the heat generating unit 63 may include a heat exchanger fin that will be explained later.

In addition, the heat absorbing unit 61 and the heat generating unit 63 may be formed to enclose outer circumferential surfaces of the exhaust path 5 and the supply path 4, respectively, such that heat can be transferred from the outer circumferential surface of the exhaust path 5 to the outer circumferential surface of the supply path 4.

When the drying of laundry is performed in the above-structured washing machine, air heated by the heating member 41 is supplied to the receiving part 2. Next, the air heat-exchanged with the laundry in the receiving part 2 is passed through the exhaust path 5 and exhausted out of the cabinet 1.

In the above process, the heat absorbing unit 61 of the heat transfer part 6 performs heat exchange with the air flowing through the exhaust path 5 whereas the heat generating unit 63 performs heat exchange with the air flowing into the supply path 4.

Here, the air flowing through the exhaust path 5 retains heat supplied from the heating member 41 whereas the air flowing into the supply path 4 has yet to be heated by the heating member 41. Accordingly, the air flowing through the exhaust path 5 has a higher temperature than the air flowing into the supply path 4.

Such a temperature difference between the heat absorbing unit 61 and the heat generating unit 63 of the heat transfer part 6 causes heat to be transferred from the heat absorbing unit 61 to the heat generating unit 63. The air flowing into the supply path 4 undergoes heat exchange with the heat generating unit 63 before being heated by the heating member 41. Thus, according to the embodiment of the present invention, the air flowing through the supply path 4 can be heated by the heat being exhausted through the exhaust path 5.

The washing machine according to the embodiment of the present invention may further include a control unit (not shown) to operate the heating member 41 to supplement heat in case the temperature of the air heated by the heat transfer part 6 is measured to be less than a predetermined reference temperature.

More specifically, the heating member 41 will surely heat the air flowing into the supply path 4 at the beginning of the drying of laundry. However, the efficiency of the heat exchange between the laundry and the heated air being supplied to the receiving part 2 through the supply path 4 may be deteriorated as the drying progresses. As a result, a quantity of heat remaining in the air being exhausted through the exhaust path 5 will be increased.

Therefore, when the temperature of the air introduced into the supply path 4 and heat-exchanged with the heat generating unit 63 approximates, but is less than, a predetermined temperature for the drying, the heating member 41 is operated so that only the lacking heat is supplemented, for example by controlling the operation time or the temperature of the heating member 41. On the other hand, when the temperature of the air is greater than the predetermined temperature, the operation of the heating member 41 is restricted so that waste of energy is not caused.

Although the embodiment of the present invention has been explained with reference to the exhausting type dryer, the embodiment is applicable to a combined drying and washing machine as long as it adopts the exhausting type drying method.

In other words, the above operational effect can be achieved even in a washing machine performing both washing and drying if the washing machine includes a tub having the receiving part 2 formed in the cabinet 1 to store wash water, a drum rotatably mounted in the tub, a supply device to supply wash water to the tub, and a drain device draining the wash water stored in the tub.

However, in this case, the supply path 4 and the exhaust path 5 both need to be formed in fluid communication with the tub. Especially, the exhaust path 5 needs to be disposed at a position not to naturally drain the wash water which is supplied to the tub to wash laundry.

To perform washing of laundry with the above-structured washing machine, the laundry is put in the drum, wash water is supplied into the tub, and then the drum is rotated.

The wash water may be drained through the drain device when drainage of the wash water is required during the washing. Also, wash water may be newly supplied to the tub using the supply device. Those processes are repeatedly performed.

After the washing is completed, drying of the laundry is performed by the heating member 41, the supply path 4, and the exhaust path 5. The heat transfer part 6 transfers heat remaining in the air being exhausted through the exhaust path 5, to the air flowing into the supply path 4. Accordingly, energy used for drying can be reduced.

Hereinafter, a washing machine according to another embodiment of the present invention will be described with reference to FIG. 2.

Figure 2:
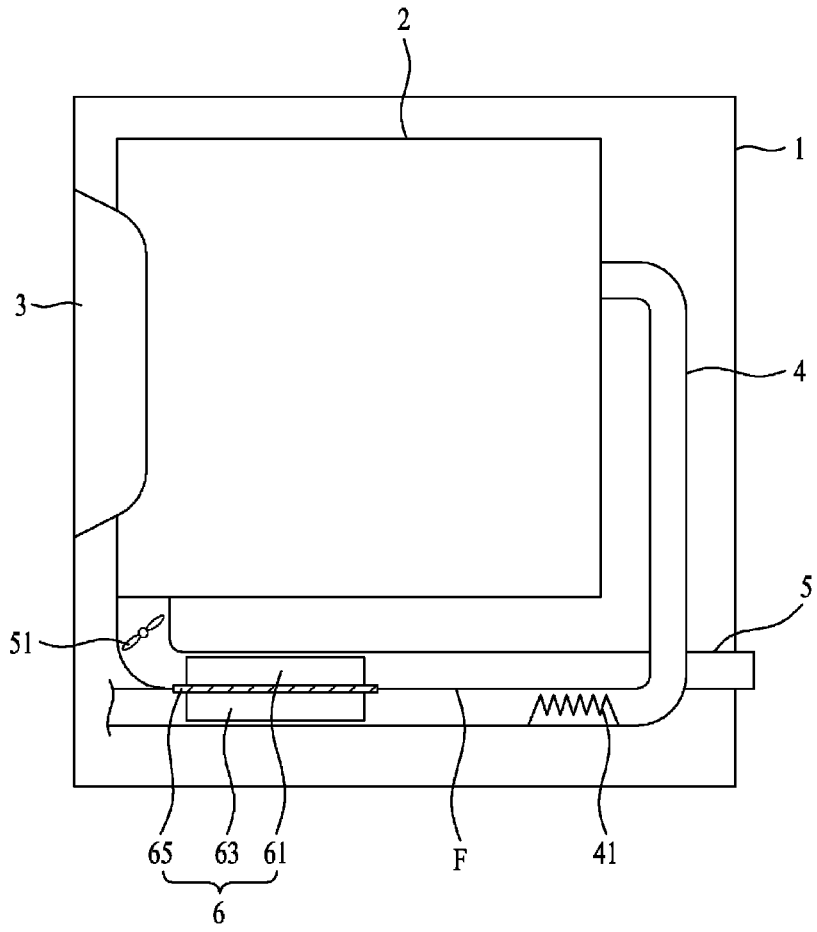
FIG. 2 illustrates a concept view of a washing machine according to a second embodiment of the present invention.

The washing machine according to the embodiment of FIG. 2 is structured so that the supply path 4 and the exhaust 5 are in contact with each other within the tub 1.

Here, if the supply path 4 and the exhaust path 5 are made of a heat conductive material, heat of the exhaust path 5 will be transferred through a contacting surface between the paths 4 and 5. Therefore, heat exchange is performed between the air flowing through the inside of the supply path 4 and an inner circumferential surface of the supply path 4. Thus, the present embodiment more efficiently recycles the heat of the exhaust path 5.

Furthermore, the heat transfer part 6 according to this embodiment is disposed at the contacting surface F between outer circumferential surfaces of the supply path 4 and the exhaust path 5, such that heat of the air flowing in the exhaust path 5 can be more efficiently transferred to the air flowing in the supply path 4.

In this case, the heat transfer part 6 may include a partition 65 formed at the contacting surface F, a heat absorbing unit 61 connected to the partition 65 and extended to the inside of the exhaust path 5, and a heat generating unit 63 connected to the partition 65 and extended to the inside of the supply path 4.

The partition 65 is formed at the contacting surface F so as to separate the supply path 4 and the exhaust path 5 from each other. Exemplarily, the partition 65 is made of a material that efficiently transfers heat.

The heat absorbing unit 61 may be structured in the form of a heat exchanger fin of which one side thereof is in contact with the partition 65 while the other side is disposed in the exhaust path 5. In the same manner, the heat generating unit 63 may be structured in the form of a heat exchanger fin of which one side is in contact with the partition 65 while the other side is disposed in the supply path 4.

A plurality of the heat exchanger fins are provided at the partition 65, exemplarily being spaced by predetermined intervals so that the air flowing into the respective paths 4 and 5 can pass through the intervals.

However, the heat absorbing unit 61 and the heat generating unit 63 may be achieved in other structures and with other materials so long as such structure and materials are capable of efficiently exchanging heat with the air flowing in the paths, without being limited to the above described embodiment.

Hereinafter, a washing machine according to still another embodiment, which includes two or more receiving parts and is capable of drying and washing laundry in the respective receiving parts, will be described with reference to FIG. 3.

The washing machine of this embodiment is characterized in that the wash water to be used for washing is heated by the heat retained in the air being exhausted through the exhaust path 5.

The washing machine of this embodiment includes a first cabinet 1 and a second cabinet 7. A first receiving part 2 is formed in the first cabinet 1. A second receiving part 8 is formed in the second cabinet 7.

Although the first and the second receiving parts 2 and 8 may be respectively formed in the first and the second cabinets 1 and 7, the first and the second receiving parts 2 and 8 may be provided in a space of one cabinet.

The first cabinet 1 includes the first receiving part 2 receiving laundry, a door 3 opening and closing the first receiving part 2, a supply path 4 guiding air into the first receiving part 2, and an exhaust path 5 exhausting the air in the first receiving part 2 therethrough.

The first receiving part 2 may be provided as a space to perform only drying or both washing and drying. In case of the latter, it is exemplary that the first receiving part 2 includes a tub (not shown) to store wash water and a drum (not shown) rotatably mounted in the tub as described above.

The exhaust path 5 is equipped with a fan 51 to forcibly blow the air present in the first receiving part 2. The supply path 4 is equipped with a heating member 41 to heat the air out of the first receiving part 2.

Since the elements of the first cabinet 1 are the same as disclosed in the embodiments of FIG. 1 and FIG. 2, a detailed description of the elements will be omitted.

The second cabinet 7 includes the second receiving part 8 receiving the laundry, a door 9 disposed on the front side of the second cabinet 7 to selectively open and close the second receiving part 8, and a supply unit S supplying wash water.

The supply unit S includes a storage part R, a storage part supply pipe S1 that supplies wash water to the storage part R, and a receiving part supply pipe S2 that supplies wash water to the second receiving part 8.

The second receiving part 8 may comprise a drum 82 to store the laundry and a tub 81 to store wash water. Exemplarily, the drum 82 is rotatably mounted in the tub 81.

The tub 81 may further include a drainpipe 83 connected to the storage part R and a valve 84 that selectively opens and closes the drainpipe 83. The receiving part supply pipe S2, which will be explained later, may be connected at one side of the tub 81.

The storage part R is a space to store wash water to be used for washing. The wash water is supplied through the storage part supply pipe S1 of the supply unit S and stored in the storage part R.

In a general washing machine, the wash water for washing is directly supplied to the tub 81. However, it is necessary to store wash water in advance so that the stored wash water is available whenever necessary, in a water-stressed region or in a region where water supply is not favorably performed. The storage part R is provided to enhance user convenience in such regions.

The storage part R is in fluid communication with the storage part supply pipe Si and also in fluid communication with the receiving part supply pipe S through which the stored wash water is supplied to the tub 81.

The storage part supply pipe S1 guides water supplied from the outside of the second cabinet 7 into the storage part R. The receiving part supply pipe S2 supplies the water stored in the storage part R to the tub 81 of the second receiving part 8.

The storage part R can be disposed at any of the inside and the outside of the second cabinet 7. The storage part R according to the present embodiment is illustrated as disposed at the inside of the second cabinet 7.

In case that the storage part R is installed at a lower part of the second receiving part 8 in consideration of weight of the storage part R holding the wash water, it is exemplary that a pump P is provided to the receiving part supply pipe S2 so as to supply the wash water in the storage part R to the tub 81.

The storage part R may further include a storage part drainpipe R1 and a storage part valve R2 to exhaust the water stored therein when necessary.

In addition, since the drainpipe 83 of the tub 81 and the storage part R are interconnected, the washing machine according to this embodiment is capable of storing the wash water discharged from the tub 81 during washing or rinsing in the storage part R and then recycling the wash water.

Especially when the washing is performed using hot water, the exhaust path 5 is used to heat the water stored in the storage part R.

As described above, the exhaust path 5 is structured to exhaust the air in the first receiving part 2 to the outside of the first cabinet 1. Here, the air being exhausted through the exhaust path 5 retains the heat supplied by the heating member 41.

Therefore, the utilizing efficiency of the heat supplied by the heating member 41 may be maximized by extending the exhaust path 5 so that the exhaust pipe 5 includes a heat exchange pipe 53 disposed in the storage part R.

In other words, the storage part R and the heat exchange pipe 53 function as a heat exchange part in this embodiment.

Also, according to this embodiment, the air being exhausted through the exhaust path 5 may be directly injected to the storage part R.

More specifically, when an end of the exhaust path 5 is disposed within the storage part R, the wash water stored in the storage part R can be heated by the heat retained in the air exhausted through the exhaust path 5.

Moreover, the washing machine according to this embodiment may further include a dedicated heating unit such as a heater to heat the wash water stored in the storage part R, while utilizing the exhaust path 5 as an auxiliary heating unit.

Figure 3:
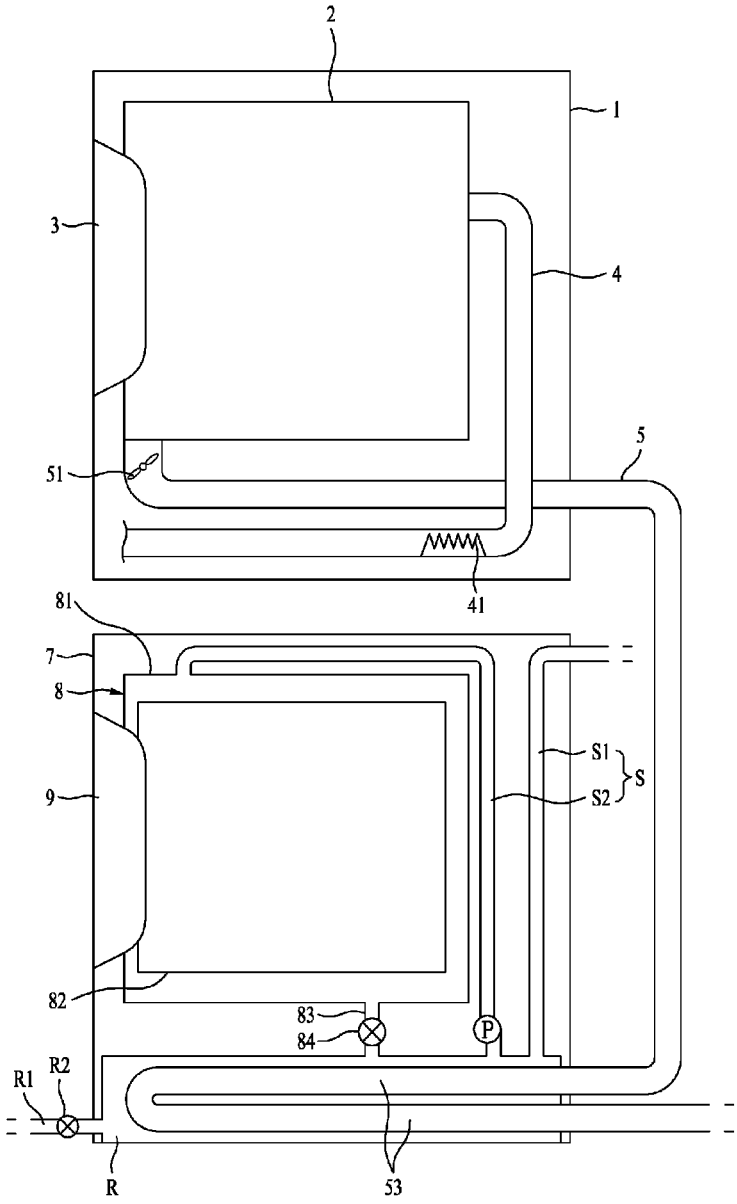
FIG. 3 illustrates a concept view of a washing machine according to a third embodiment of the present invention.

Referring to FIG. 3, the exhaust path 5 extends out from the first cabinet 1 and then passes through the inside of the storage part R. However, since this structure is provided only by way of illustrative example, various other structures may be applied as long as the same effect is achieved.

For example, if the first cabinet 1 and the second cabinet 7 are in contact with each other in a vertical direction or lateral direction, the exhaust path 5 may penetrate a contacting surface between the cabinets 1 and 7 and pass through the inside of the storage part R. According to this, contact between the air flowing through the exhaust path 5 and the air out of the cabinets 1 and 7 can be prevented. Therefore, the heat of the air flowing through the exhaust path 5 can be more efficiently utilized.

In a case where the first and the second receiving parts 2 and 8 are formed in one cabinet, a partition to separate the cabinet is omitted while a distance between the exhaust path 5 and the storage part R is minimized. As a result, the efficiency of utilizing the heat of the air flowing through the exhaust path 5 can be improved.

Although the present embodiment has been explained only for the case where the wash water is stored in the storage part R and then supplied by the pump P, there may be provided an additional structure for supplying the wash water directly to the tub 81.

In this case, a user may use the storage part R when storage of the wash water for washing is required, and immediately supply the wash water to the second receiving part 8 when use of the storage part R is unnecessary. Thus, the convenience of use is considerably improved.

Figure 4:
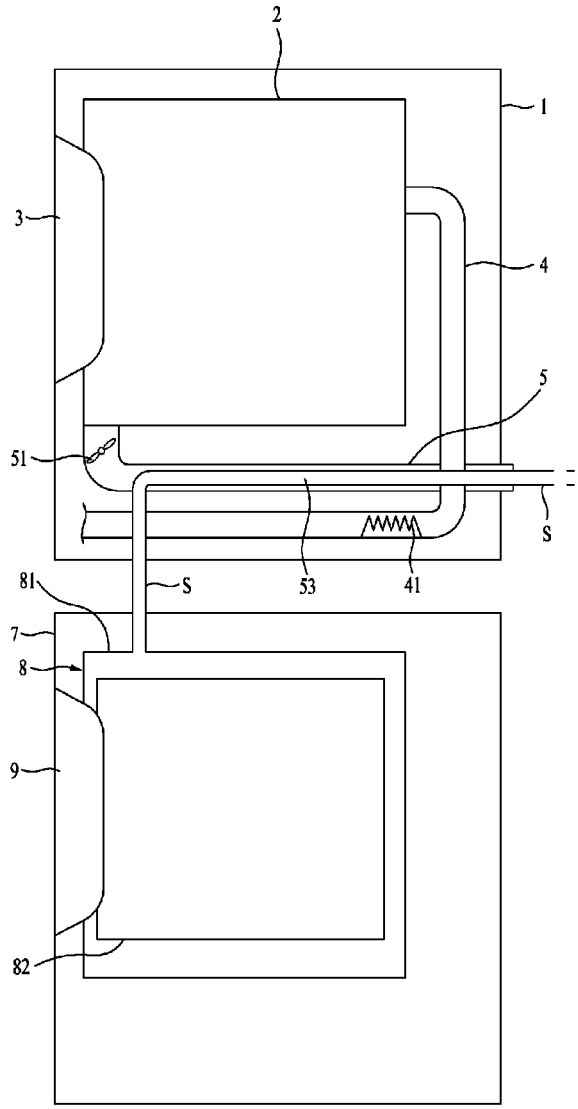
FIG. 4 illustrates a concept view of a washing machine according to a fourth embodiment of the present invention.

Hereinafter, a washing machine according to a further embodiment of the present invention will be described with reference to FIG. 4.

The present embodiment is characterized in that the wash water is heated by heat retained in the air exhausted through the exhaust path, that is, almost the same as the embodiment shown in FIG. 3. However, the present embodiment is distinctive in that the storage part R is omitted.

However, the present embodiment does not exclude application to a washing machine having the storage part R and therefore is also applicable to the embodiment shown in FIG. 3.

The washing machine according to the present embodiment includes a first cabinet 1 and a second cabinet 7. A first receiving part 2 is formed in the first cabinet 1 and a second receiving part 8 is formed in the second cabinet 7.

The first and the second receiving parts 2 and 8 may be provided separately in the respective cabinets or together in one cabinet.

The first cabinet 1 includes the first receiving part 2 receiving laundry, a door 3 opening and closing the first receiving part 2, a supply path 4 guiding air into the first receiving part 2, and an exhaust path 5 exhausting the air in the first receiving part 2 therethrough.

The first receiving part 2 may be provided as a space to perform only drying or both washing and drying. In case of the latter, it is exemplary that the first receiving part 2 includes a tub (not shown) to store wash water and a drum (not shown) rotatably mounted in the tub as described above.

The exhaust path 5 is equipped with a fan 51 to forcibly blow the air inside of the first receiving part 2. The supply path 4 is equipped with a heating member 41 to heat the air out of the first receiving part 2.

Since the elements structured in the first cabinet 1 are the same as disclosed in the previous embodiments, a detailed description of the elements will be omitted.

The second cabinet 7 includes therein the second receiving part 8 receiving the laundry, a door 9 disposed on the front side of the second cabinet 7 to selectively open and close the second receiving part 8, and a supply pipe S supplying the wash water to the second receiving part 8.

The second receiving part 8 may include the tub 81 and the drum 82 to supply spaces for storing the laundry and the wash water.

The supply pipe S supplies the wash water to the tub 81 of the second receiving part 8, and exemplarily includes the heat exchange unit 53 which passes through the inside of the exhaust path 5.

The heat exchange unit 53 disposed in the exhaust path 5 is made of a material efficiently exchanging heat with the air flowing through the exhaust path 5. A plurality of heat exchanger fins (not shown) may be formed on an outer circumferential surface of the heat exchange unit 53.

As the air in the first receiving part 2 is exhausted through the exhaust path 5 and the wash water is supplied to the second receiving part 8 through the supply pipe S, the heat from the heat exchange unit 53 is applied to the wash water.

Accordingly, the washing machine of the present embodiment is capable of heating the wash water supplied to the second receiving part 8 using the air discarded from the first receiving part 2.

Although the present embodiment has been explained for the case where the supply pipe S passes through the inside of the exhaust path 5, the exhaust path 5 and the supply pipe S may be in contact with each other by the outer circumferential surfaces thereof so that heat exchange is achieved.

In addition, the exhaust path 5 may be structured such that the air flowing through the exhaust path 5 is supplied directly to the second receiving part 8.

That is, one side of the exhaust path 5 may be fluidly communicated with the first receiving part 2 while the other side is fluidly communicated with the second receiving part 8, such that the wash water supplied to the second receiving part 8 through the supply pipe S can be heated by the air injected from the exhaust path 5.

For another example, the exhaust path 5 may be branched so that one side thereof is drawn to the outside of the first cabinet 1 while the other side is extended to the second receiving part 8. In this case, the user is able to selectively recycle the air exhausted from the exhaust path 5. Additionally, a control valve may be further provided at the branching position of the exhaust path 5 to selectively open the respective branched paths.

Although the above embodiments of the present invention have been illustrated with reference to a drum-type washing machine, the embodiments are also applicable to a top-loading washing machine.

That is, when the receiving parts shown in FIG. 1 to FIG. 4 are provided in a direction perpendicular to bottoms of the cabinets, the same effect as described with the embodiments can be obtained.

Also, the receiving part may be mounted perpendicularly to the cabinet 1 and include an outer tub to store wash water and an inner tub mounted to be rotated in the outer tub. In such a structure, the supply path and the exhaust path may be formed in fluid communication with the outer tub. The exhaust path is disposed at a proper position not causing drainage of the wash water supplied to the outer tub.

Furthermore, the embodiments of the present invention are applicable to various home appliances having an exhausting type drying structure that discards air in a drying space to the outside of a cabinet.

A dish washer may be taken as an example of the home appliance. The dish washer may include a receiving part to receive dishes, a supply path to supply air to the receiving part, and an exhaust path to exhaust the air in the receiving part.

In this case, a heating member is provided at the supply path so as to heat the air. Additionally, a heat transfer part may be provided to the supply path and the exhaust path so that heat of the air flowing through the exhaust path can be transferred to the air flowing through the supply path.

Accordingly, the heat retained in the air discarded through the exhaust path during drying of washed dishes can be recycled into heat for drying dishes.

Thus, the embodiments of the present invention are applicable to various appliances requiring the exhausting type drying function, and are not limited to the above described cases.

Various embodiments have been described in the best mode for carrying out the invention.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A washing machine comprising:

a first receiving part configured to receive and dry laundry, the first receiving part having a first door to open and close the first receiving part;

a second receiving part that is separate from the first receiving part and configured to receive wash water and to wash laundry, the second receiving part having a second door to open and close the second receiving part;

a supply path to supply air to the first receiving part therethrough;

a heating member to heat the air in the supply path;

an exhaust path to exhaust the air in the first receiving part to the outside of the first receiving part therethrough; and a heat transfer part to transfer heat retained in the air being exhausted through the exhaust path to the wash water supplied to the second receiving part, wherein the heat part comprises:

a storage part to store the wash water to be supplied to the second receiving part; and a heat exchange pipe extending from the exhaust path and disposed in the storage part.

2. The washing machine according to claim 1, wherein the heat exchange pipe includes a plurality of heat exchanger fins.

3. The washing machine according to claim 1, wherein the first receiving part comprises:

a tub communicated with the supply path and the exhaust path and adapted to store wash water; and a drum rotatably mounted in the tub and adapted to receive laundry.

4. The washing machine according to claim 1, wherein the second receiving part comprises:

a tub to store wash water; and a drum rotatably mounted in the tub and adapted to receive laundry.

5. The washing machine according to claim 4, wherein the second receiving part further comprises a supply pipe to supply the wash water to the tub, and the heat transfer part is a part of the supply pipe which is disposed in the exhaust path.

6. The washing machine according to claim 5, wherein the heat transfer part further comprises a heat exchanger fin formed on an outer circumferential surface of the supply pipe disposed in the exhaust path.

7. The washing machine according to claim 1, wherein the exhaust path further comprises a fan to exhaust the air in the first receiving part.

8. The washing machine according to claim 4, wherein the tub further includes a drainpipe connected to the storage part and a valve that selectively opens and closes the drainpipe.

9. The washing machine according to claim 1, wherein the storage part includes a storage part drainpipe and a storage part valve to exhaust the wash water stored therein.

10. The washing machine according to claim 4, further comprising:

a storage part supply pipe configured to supply the wash water into the storage part; and a receiving part supply pipe configured to supply the wash water in the storage part into the tub of the second receiving part.

11. The washing machine according to claim 10, wherein a pump is provided to the receiving part supply pipe so as to supply the wash water in the storage part to the tub.

12. A washing machine comprising:

a first receiving part to configured to receive and dry laundry;

a second receiving part that is separate from the first receiving part and configured to receive wash water and to wash laundry;

a supply path to supply air to the first receiving part therethrough;

a heating member to heat the air in the supply path;

an exhaust path to exhaust the air in the first receiving part to the outside of the first receiving part therethrough; and a heat transfer part to transfer heat retained in the air being exhausted through the exhaust path to the wash water supplied to the second receiving part, wherein the heat transfer part comprises: a storage part to store wash water to be supplied to the second receiving part; and a heat exchange pipe extended from the exhaust path and disposed in the storage part to heat the wash water stored in the storage part by the heat retained in the air exhausted through the exhaust path.

13. The washing machine according to claim 12, wherein the second receiving part comprises:

a tub to store wash water; and a drum rotatably mounted in the tub and adapted to receive laundry.

14. The washing machine according to claim 12, wherein the exhaust path further comprises a fan to exhaust the air in the first receiving part.

15. The washing machine according to claim 12, wherein the storage part includes a storage part drainpipe and a storage part valve to exhaust the wash water stored therein.

16. A washing machine comprising:

a first receiving part configured to receive and dry laundry, the first receiving part having a first door to open and close the first receiving part;

a second receiving part that is separate from the first receiving part and configured to receive wash water and to wash laundry, the second receiving part having a second door to open and close the second receiving part;

a supply path to supply air to the first receiving part therethrough;

a heating member to heat the air in the supply path;

an exhaust path to exhaust the air in the first receiving part to the outside of the first receiving part therethrough; and a heat transfer part to transfer heat retained in the air being exhausted through the exhaust path to the wash water supplied to the second receiving part, wherein the heat transfer part comprises: a storage part to store wash water to be supplied to the second receiving part; and a heat exchange pipe extended from the exhaust path and disposed in the storage part to heat the wash water stored in the storage part by the heat retained in the air exhausted through the exhaust path.

17. The washing machine according to claim 16, wherein the second receiving part comprises:

a tub to store wash water; and a drum rotatably mounted in the tub and adapted to receive laundry.

18. The washing machine according to claim 16, wherein the exhaust path further comprises a fan to exhaust the air in the first receiving part.

19. The washing machine according to claim 16, wherein the storage part includes a storage part drainpipe and a storage part valve to exhaust the wash water stored therein.

* * * * *